United States Patent [19]

Kozuka et al.

[11] 4,453,340

[45] Jun. 12, 1984

[54] TOY HAVING MOVING MODES DEPENDENT UPON LOCATION OF MOVING MEMBER

[75] Inventors: Michihiro Kozuka; Masayuki Tonokura, both of Tokyo, Japan

[73] Assignee: Tomy Kogyo Co., Inc., Japan

[21] Appl. No.: 379,773

[22] Filed: May 19, 1982

[30] Foreign Application Priority Data

May 30, 1981 [JP] Japan ..... 56-79127

[51] Int. Cl.[3] ..... A63H 17/26

[52] U.S. Cl. ..... 446/437; 446/460; 446/288; 446/310

[58] Field of Search ..... 46/201, 202, 206, 211, 46/209, 251, 106, 99, 98, 97, 146, 107

[56] References Cited

U.S. PATENT DOCUMENTS

| | | | |
|---|---|---|---|
| 1,599,965 | 9/1926 | Heimer | 46/146 X |
| 1,855,702 | 4/1932 | Berger | 46/211 |
| 3,712,359 | 1/1973 | Williams | 46/221 X |
| 3,859,752 | 1/1975 | Morrison et al. | 46/201 |

FOREIGN PATENT DOCUMENTS

| | | | |
|---|---|---|---|
| 476872 | 12/1952 | Italy | 46/201 |

*Primary Examiner*—Mickey Yu

*Attorney, Agent, or Firm*—K. H. Boswell; Edward D. O'Brian

[57] ABSTRACT

A toy has a body which is divided into a main section and a supplemental section. The supplemental section is movably mounted on the main section between a first and second position. A motor is located within the main section and connected to the motor are a set of drive wheels. The drive wheels extend out of the bottom of the main section and are positioned such that one of the drive wheels is on one side of the longitudinal center line of the main section and the other of the drive wheels is on the other side of the longitudinal center of the main section and both of the drive wheels are located on one side of the transverse center line of the main section. A guide wheel is located on the main section and is positioned such that at least a portion of the guide wheel extends below the main section and is located on one side of the longitudinal center line of the main section and is on the opposite side of the transverse center line from that of the driving wheels. When the supplemental section is in its first position a greater portion of its weight is supported by the guide wheel than when the supplemental section is in its second position. As the guide wheels propel the toy over a surface in response to the motor, the direction of travel of the toy when the supplemental section is in the first position is different from the direction of travel of the toy when the supplemental section is in the second position.

10 Claims, 8 Drawing Figures

TOY HAVING MOVING MODES DEPENDENT UPON LOCATION OF MOVING MEMBER

BACKGROUND OF THE INVENTION

This invention is directed to a toy which has a supplemental body portion which is movable with respect to the main body portion between a first and second position and when the supplemental body portion is in the first position a guide wheel on the bottom of the toy supports a greater percentage of the weight of the toy than when the supplemental portion is in the second position, resulting in the toy following a different pathway of travel between when the supplemental portion is in the first position and when it is in the second position. In the preferred embodiment of the toy, the toy is formed as a jack-in-the-box and the supplemental portion includes a lid which moves between a closed position and an open position. The jack portion of the jack-in-the-box toy is utilized to move the lid between the closed and open positions.

A variety of jack-in-the-box type toys are known. Most of these are directed for use by very small children and, upon turning of a crank or the like, the lid of the toy will pop open, releasing the jack to surprise the user of the toy. The fascination of this type of toy is limited to a very young age group. As the child increases in his sophistication with age, the mere popping open of the top of the jack-in-the-box and the exposure of the jack portion accompanying this move causes the child to lose interest.

Many vehicular type toys are known which are capable of moving in a pathway across a support surface. These range from normal cars and trucks to a variety of other wheeled vehicles, including movable robots and the like. Most of these vehicles are capable of movement only along a particular set pathway, that is, they are capable of either linear movement, if in fact, all the wheels are fixed, or, possibly, movement in a circular manner if one or more wheels are set at an angle with respect to the remainder of the wheels.

Of the majority of the above described vehicles, only certain very complicated vehicles, which include a radio controlled steering mechanism. or a flexible cable or the like, are able to randomly move from a linear pathway to a curved pathway. Normally, these vehicles are geared to slightly older children and their cost and complexity precludes their use by pre-schoolers and early grammer school age children.

It is believed that a vehicle which is capable of traveling in both a curved pathway and a linear pathway without sophisticated or complicated controls would have considerable play value for pre-school and early grammer school age children. Furthermore, it is believed that a vehicle which incorporated the jack-in-the-box concept in conjunction with the variety of movements noted in the preceding sentence would be extremely interesting and enjoyable for this age children.

BRIEF DESCRIPTION OF THE INVENTION

In view of the above, it is a broad object of this invention to provide a toy which is capable of producing in a first instance a first type of movement, and in a second instance a second type of movement. Furthermore, it is an object of this invention to provide such a toy which is exceedingly simple in its construction and engineering and thus would be an ideal, inexpensive toy for smaller children. Additionally, however, it is an object of this invention to provide a toy which embodies certain engineering principles that allow it to perform at least two types of movement without complicated or sophisticated mechanisms.

These and other objects, as will become evident from the remainder of this specification, are achieved in a toy which comprises a body, said body divided into at least a main section and a supplemental section, said supplemental section movably mounted on said main section to move between at least a first position and a second position; a motor means located in said main section of said body; a set of drive wheels operatively associated with said motor means so as to be rotated by said motor means, said set of drive wheels located on said main section of said body and positioned such that at least a portion of said drive wheels extends below said main section of said body and contacts a support surface, one of said drive wheels located on one side of the longitudinal center line of said main section of said body and the other of said drive wheels located on the other side of the longitudinal center line of said main section of said body, both of said drive wheels located on one side of the transverse center line of said main section of said body; a guide means located on said main section of said body in a position such that at least a portion of said guide means contacts said support surface, said guide means located on one side of said longitudinal center line of said main section of said body and on the opposite side of said transverse center line of the main section of said body from said drive wheels; said drive wheels supporting at least a portion of the weight of said toy on a support surface and said guide means supporting the remaining portion of the weight of said toy on said support surface, the portion of the weight of said toy supported by said guide means being greater when said supplemental section of said body is in said first position than when said supplemental section of said body is in said second position such that as said drive wheels rotate said toy is propelled over said support surface and the direction of travel of said toy on said support surface when said supplemental section is in said first position is different than the direction of said toy on said support surface when said supplemental section is in said second position.

In the preferred embodiment of the toy of the invention, a moving means would be operatively associated with both the motor means and the supplemental section of the body such that the moving means would move the supplemental section of the body from its first to its second position under the influence of the motor means. Furthermore, in the preferred embodiment of the invention, the toy would be capable of traveling in a first curved pathway when the supplemental section is in its first position, and in one of a second curved pathway and a straight pathway when the supplemental section is in its second position. The radius of curvature of the first curved pathway would be smaller than the radius of curvature of the second curved pathway.

In the preferred embodiment of the invention, the guide means would comprise a guide wheel rotatably mounted on the main body section in a location on the main body section such that at least a portion of the guide wheel extends below the main body section and contacts the support surface. The line of travel of the guide wheel would be preferredly oriented at an acute angle to the line of travel of the drive wheel located on the same side of the longitudinal center line as is the guide wheel.

In the preferred embodiment of the invention, each of the drive wheels would include a discontinuity in their periphery such that the circumference of each of these drive wheels does not form a continuous circle. Preferredly, the discontinuity would be formed as an opening located in the circumference of the drive wheel. Preferredly the openings in the drive wheel would be spaced 180° apart from each other.

In the preferred embodiment of the invention the supplemental section of the body would include a first portion pivotally mounted on the main section at a point which is located on the same side of the transverse center line as are the drive wheels. Preferredly, the moving means would be capable of contacting said portion and pivoting said portion with respect to the main body section to move the portion with respect to the main body section. Preferredly, this portion would comprise a hinged lid hinged to the main body section and movable between a first position wherein the lid fits over the main body section, and a second position wherein the lid extends away from the main body section on the same side of the transverse center line as are the drive wheels.

In the illustrated embodiment of the invention herein, the preferred embodiment of the invention is illustrated as a jack-in-the-box toy which includes a box having a lid hinged to the top of the box along the upper back edge of the box. A spring mounted "jack" is mounted in the interior of the box, and is capable of being located inside of the box when the spring is compressed with the lid closed over it. A holding member would be utilized to maintain the "jack" located in the box against the compression of the spring. The box would include a set of driving wheels extending out of the bottom of the box near the rear bottom edge of the box, and a front guide wheel extending out of the bottom of the box near the front edge of the box on one side of the box. The guide wheel would be set at an angle with respect to the drive wheels such that the front edge of the guide wheel is closer to the side of the box than the back edge of the guide wheel with respect to that side of the box on which the guide wheel is located. A motor would be located in the box which moves both the guide wheel and the member holding the "jack" against the compression of the spring. The box would move over a support surface in very tight circles when the "jack" was located inside the interior of the box with the lid closed over it and the box would move in more of a straight pathway when the member released the "jack" allowing the "jack" to flip the box lid open.

BRIEF DESCRIPTION OF THE DRAWINGS

This invention will be better understood when taken in conjunction with the drawings wherein.

Figure 1:
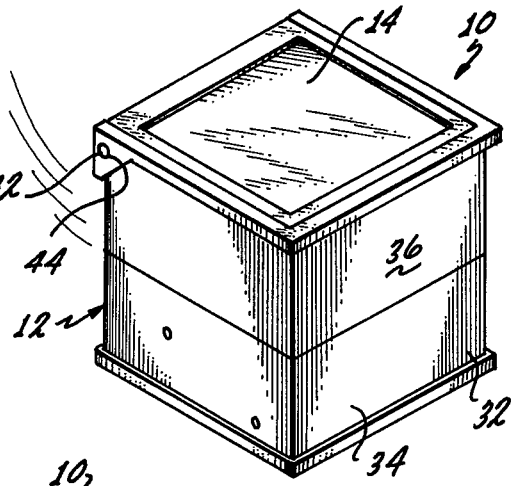
FIG. 1 shows an oblique view of the preferred embodiment of the invention in a closed configuration.

The invention described in this specification and illustrated in the drawings is directed to certain principles and/or concepts as are set forth in the claims appended to this secification. Those skilled in the toy arts will realize that these principles and/or concepts are capable of being illustrated in a variety of embodiments differing from the exact illustrated embodiment utilized herein. For this reason, this invention is not to be construed as being limited to the exact illustrated embodiment, but is to be construed in light of the claims.

DETAILED DESCRIPTION OF THE INVENTION

The embodiment utilized for illustrative purposes of this invention is shown in the drawings as a toy jack-in-the-box 10. It includes a box or body section 12 having a lid 14 hinged on the top of the body 12. Located inside is a jack 16 mounted on a spring 18. Two rear drive wheels 20 and 22 are rotated by a spring motor 24 which is wound utilizing knurled knob 26. A guide wheel 28 is located near the front of the body 12 on one side.

Portions of both of the rear wheels 20 and 22 and the guide wheel 28 extend from the bottom 30 of the body 12 such that they contact the support surface and support the jack-in-the-box 10 above that support surface. The guide wheel 28 is located near the front right hand edge 32 of the body 12. It is set to the front of the transverse center line of the body 12 and to the right of the longitudinal center line. The rear wheels 20 and 22 are set to the rear of the transverse center line with one of the wheels 20 on the right side of the longitudinal center line and the other of the wheels 22 on the right side of the longitudinal center line.

Figure 2:
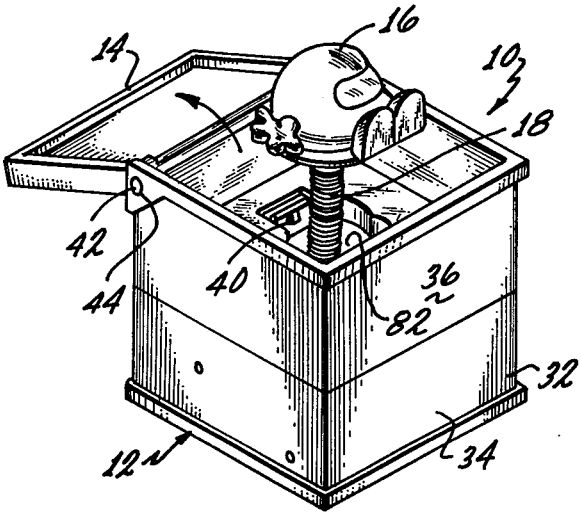
FIG. 2 is similar to FIG. 1 with the exception that the preferred embodiment of the invention is shown in an open configuration.

To operate the toy, the jack 16 is depressed downwardly within the body 12 until it is locked in position as hereinafter explained and the lid 14 is closed over the body 12. The knurled knob 26 is wound to energize the motor 24 and the toy 10 is set on a support surface. When released, the toy 10 starts moving in small circular arcs about the front right hand edge 32 of the body 12. The toy continues to spin in very small arcs, pivoting or rotating essentially near a center of rotation which is closest to the right hand front edge 32 than to any other edge of the toy 10. After the toy has moved in this spinning manner for a period of time, as governed by the internal mechanism as hereinafter explained, the jack 16 is released and it pops up on the spring 18, and in so doing, pushes the lid 14 from the closed position as seen in FIG. 1 to the open position as seen in FIG. 2. With the opening of the lid 14 and the popping up of the jack 16, the toy 10 no longer spins about the front right hand edge 32 but now moves on the support surface in either an almost straight pathway or a curved pathway which only has a very small right hand curvature to it. The curvature of the pathway after the lid 14 is open compared to when it is closed is quite dramatic. When the lid 14 is closed the curvature of the pathway which the toy 10 travels has a very small radius and is centered about the front right hand edge 32 as previously noted. After the lid 14 is open, any curvature of the pathway which the toy 10 travels has a very large radius and it approaches a straight line.

The body 12 is formed of a bottom shell 34 and a top shell 36. The top shell 36 includes a plate 38 which is sculptured in its center for attachment of the spring 18 in forming a suitable base for the jack 16 when it is located inside of the body 12. A flexible finger 40 is formed as a portion of the plate 38 and assists in holding the jack 16 within the body 12.

The lid 14 is hinged onto the upper back edge of the body 12 via two short axle segments collectively identified by the numeral 42, only one of which is shown in the drawings. Each of the axle sections 42 are located on one of the edges of the lid 14 and they fit into appropriate bearing holes collectively identified by the numeral 44 and, as with the axle 42, only one is seen in the Figs.

A shaft 46 extends out of the motor 24 and has the knurled knob 26 located on its end. The shaft 46 extends completely through the motor 24, and on the side of the motor 24 opposite where the knurled knob 26 is located, a bushing 48 maintains the shaft in correct position with relationship to the motor 24. A pinion 50 is located on the opposite end of the shaft 46 from where the knurled knob 26 is located.

An axle 52 passes through the motor 24 and includes the left rear wheel 22 located on one of its ends and the right rear wheel 20 located on its other end. These wheels are fixed to the axle 52 and rotate with respect to rotation of the axle 52. The motor 24 is conventional in nature and would include appropriate gears and the like within its interior which connect to the axle 52 and drive the rear wheels 20 and 22. In any event, both the shaft 46 and the axle 52 are rotated with respect to unwinding of the spring motor 24.

A gear 54 having teeth around approximately three quarters of its periphery is mounted via a small axle 56 to the side of the bottom shell 34. The gear 54 meshes with the pinion 50. The gear 54 includes a sector 58 which extends outwardly from the main circumference of the gear 54. The sector 58 is attached to the gear 54 via the small section 60. This makes the sector 58 somewhat of a spring arm. The gear 54 includes a tooth 62 fixedly located on its outside surface. The tooth 62 is wedge-shaped in side section.

Figure 4:
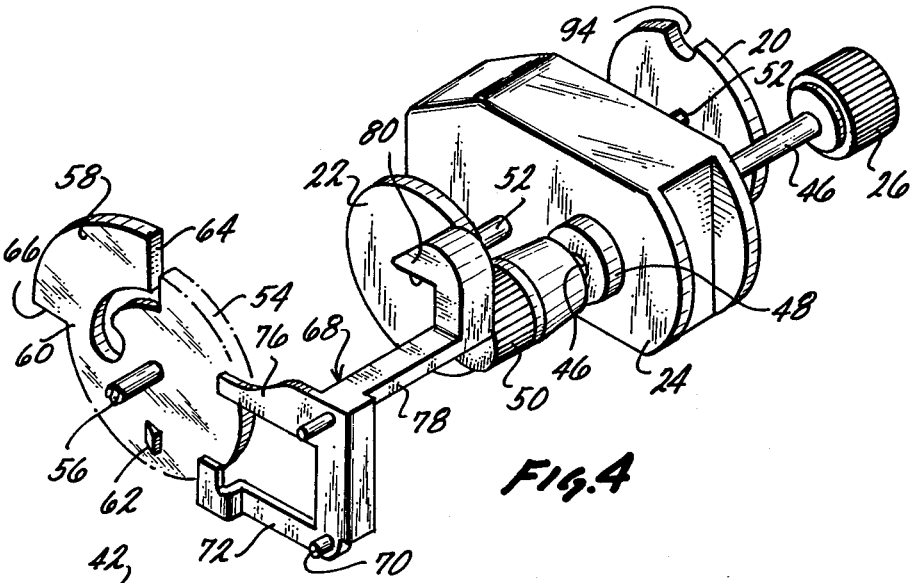
FIG. 4 is an oblique view of certain of the internal components seen in FIG. 3.
Figure 5:
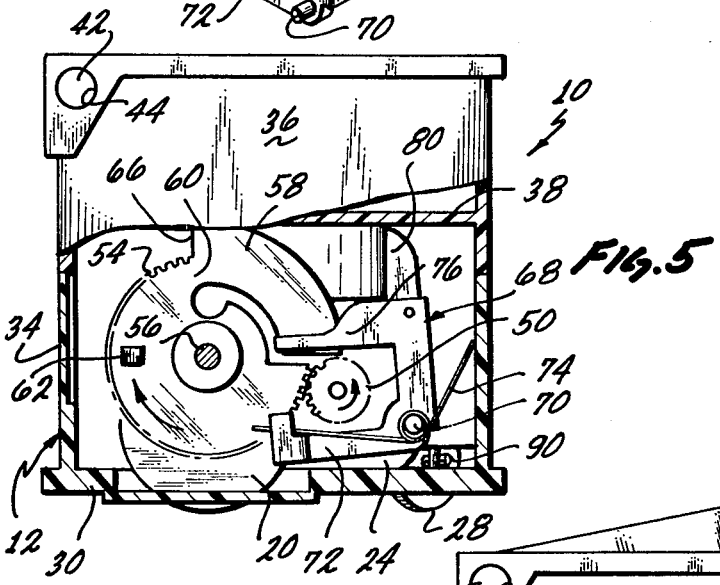
FIG. 5 is a side elevational view in partial section showing operation of the invention with certain of the internal components in a first spatial relationship.

In reference to FIG. 4, to wind the motor 24, the knurled knob 26 is rotated counterclockwise. In rotaing the knurled knob 26 counterclockwise, the gear 54 rotated clockwise. The motor 24 is wound until the edge 64 of the sector 58 contacts the pinion 50 and this contact between the edge 64 and the pinion 50 prevents further rotation of the gear 54, which in turn prevents further winding of the motor 24. The spring arm effect of the sector 58 rides on somewhat of a cushion when the edge 64 first abutts the pinion 50 and absorbs the last energy imparted to rotating the knurled knob 26 such that the user knows that the winding of the motor 24 is complete. FIG. 5 shows the location of certain components at the moment when the spring motor 24 is completely wound.

With unwinding of the spring motor 24, the gear 54 rotates counterclockwise. It will continue rotating counterclockwise until the edge 66 of the sector 58 contacts the underneath side of the pinion 50 which then prevents further rotation of the sector 58 and stops the unwinding of the motor 24. During unwinding of the motor 24, between when the edge 64 leaves the top of the pinion 50 and the edge 66 contacts the bottom of the pinion 50, the rear wheels 20 and 22 are rotated clockwise, driving the toy 10 against a support surface.

A member 68 is hinged to the bottom shell 34 via an axle 70. The member 68 includes a bottom arm 72. A hairpin spring 74 is mounted on the axle 70 next to member 68. One arm of the hairpin spring 74 contacts the arm 72 and the other arm of the hairpin spring 74 contacts the inside of the bottom shell 34. The spring 74 thus biases the arm 72 of the member 68 downwardly as viewed in FIGS. 5 and 6, causing a counterclockwise bias to be introduced into the member 68.

Figure 6:
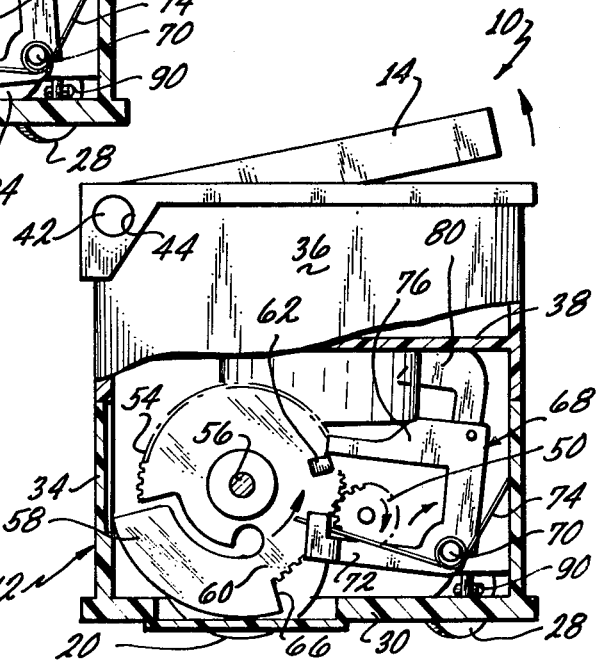
FIG. 6 is a side elevational view in partial section similar to FIG. 5 except that certain of the components are shown in a different spatial configuration than as seen in FIG. 5.

The member 68 carries an upper arm 76 which is positioned to interact with the tooth 62 on the gear 54. During winding of the motor 24, the wedge shape of the tooth 62 allows the tooth 62 to press the arm 76 outwardly, allowing for movement of the tooth 62 by the arm 76 as the gear 54 is rotated. During unwinding of the motor 24, when the tooth 62 contacts the end of the arm 76, its square edge abutts this arm as seen in FIG. 6. This causes rotation of the member 68 clockwise about its axle 70 against the bias of the spring 74.

A third arm 78 on the member 68 carries a dog 80 on its end. The dog 80 passes upwardly through the plate 38 and is positioned opposite the flexible finger 40 within a depression 82 formed in the plate 38. Upon clockwise rotation of the member 68 the dog 80 is moved from the position seen in FIG. 7 to the position seen in FIG. 8.

Figure 7:
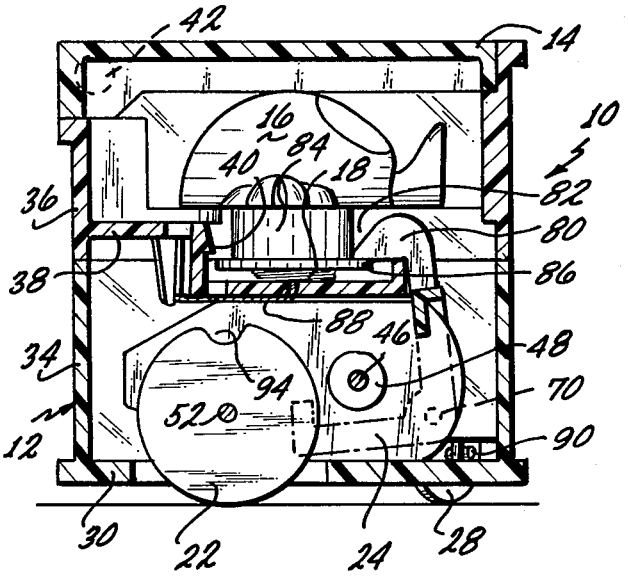
FIG. 7 is a side elevational view in partial section showing other of the components located within the interior of the preferred embodiment of the invention when it is in the configuration as is seen in FIG. 1.

The jack 16 has a cylindrical section 84 on its bottom which carries a flange 86. When the jack 16 is depressed downwardly within the body 12, the cylindrical section and the flange 84 and 86 fit within the depression 82. The flange 86 becomes locked underneath the flexible finger 40 and the dog 80 of the member 68. Its locked position is as seen in FIG. 7. During unwinding of the motor 24 when the tooth 62 on the gear 54 engages the arm 72 and rotates the member 68 clockwise, movement of the member 68 clockwise, as noted above, moves the dog 80 clockwise. This moves the dog 80 from engagement with the flange 86 and allows the jack 16 to be raised upwardly under the bias of its spring 18.

Figure 8:
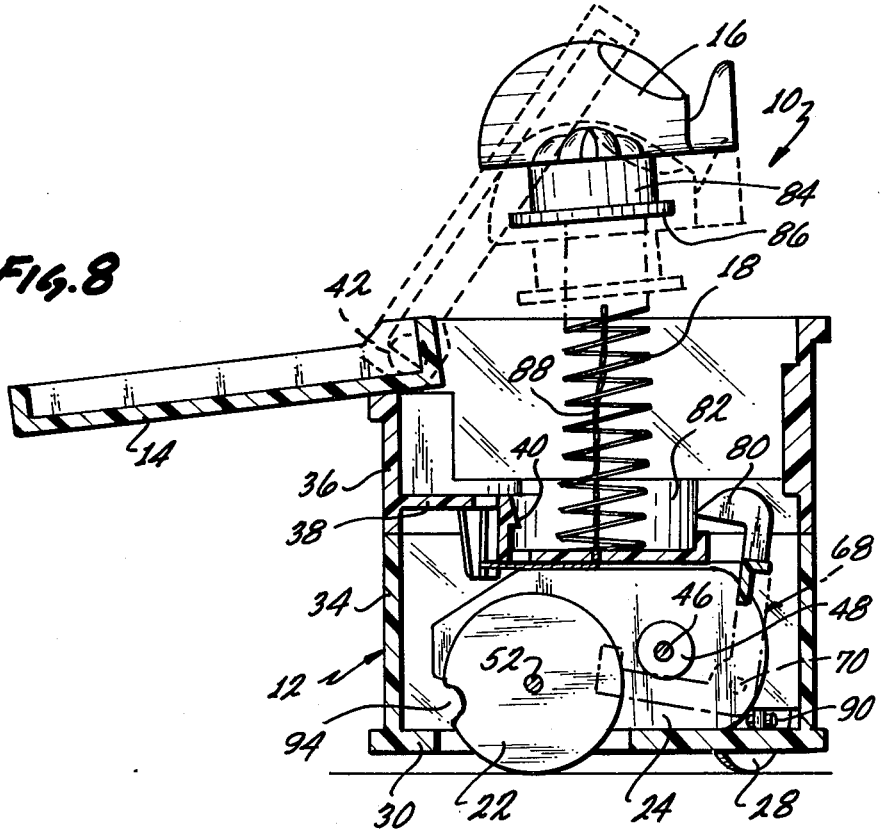
FIG. 8 is a side elevational view in partial section partly in phantom showing those components illustrated in FIG. 7 in different spatial relationships than as seen in FIG. 7.

A string or cord 88 is attached to the bottom of the jack 16 and passes within the spring 18 and attaches to the bottom of the plate 38. The cord 88 governs the uppermost movement of the jack 16 under the bias of the spring 18. When the jack 16 is released by movement of the dog 80 it pops upwardly under the bias of the spring 18. In so doing, it rotates the lid 14 from the closed position as seen in FIGS. 1, 5 and 7 to an open position as seen in FIG. 2 and in solid line in FIG. 8. FIG. 8 further shows in phantom line intermediate positions of the jack 16 and the lid 14 as the lid 14 is being opened by upward movement of the jack 16.

The guide wheel 28 is mounted on an axle 90 which is held in position by a plurality of pegs collectively identified by the numeral 92 which are formed on the inside of the bottom shell 34. Guide wheel 28 is free to spin about its axle 90.

Figure 3:
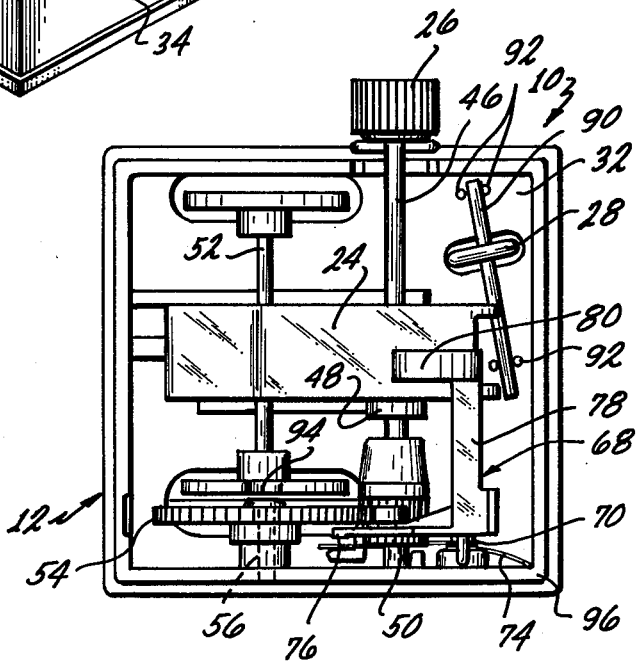
FIG. 3 is a top plan view of that section of the invention shown in FIGS. 1 and 2 located below the line extending around the center of the preferred embodiment illustrated therein.

The guide wheel 28 is oriented such that its line of travel, if projected forward, would intersect the line of travel of the rear wheel 20 at an acute angle somewhere in front of the front right hand edge 32 of the body 12. The orientation of the guide wheel 28 with respect to the direction of travel of the rear wheels 20 and 22 is as seen in FIG. 3. Together, the guide wheel 28 and the rear wheels 20 and 22 form somewhat of a triangular shaped support base for the toy 10.

Each of the rear wheels 20 and 22 contain a cut-out collectively identified by the numeral 94 in the Figs. The cut-outs 94 on the respective rear wheels 20 and 22 are spaced apart from each other 180°. Since the rear wheels 20 and 22 are fixed to their axle 52 the cut-outs 94 retain this spatial orientation with respect to one another. The cut-outs 94 form a discontinuity in the circumference of each of the rear wheels 20 and 22. As will be evident below, the discontinuity formed by the cut-outs 94 causes some rocking of the body 12 as the rear wheels 20 and 22 spin and contact the support surface. Other equivalents to the cut-outs 96 could include similar irregularities of the outside periphery of each of the rear wheels 20 and 22.

When the toy 10 is moving in a forward direction under the rotation of the rear wheels 20 and 22 with the lid 14 closed, the weight of the lid 14, as well as the remainder of the body 12 and the components located therein, is supported by the triangular arrangement of the wheels 20, 22 and 28. Since the wheel 28, however, is located to one side of the longitudinal center line of the body 12 toward the front right hand edge 32, and is incanted at a slight angle to the direction of travel of the rear wheel 20, the drive wheel 22 supports a greater proportion of the weight of the toy 10 than the drive wheel 20 and as such its interaction with the contact surface is somewhat stronger than the interaction of the drive wheel 20. This results in the drive wheel 22 exerting a greater force against the support surface than drive wheel 20 to drive or pivot the toy 10 about the guide wheel 28, causing the toy 10 to rotate about a center of rotation somewhat positioned near the front right hand edge 32. As long as the lid 14 remains closed, the toy 10 will exhibit this mode of movement.

Upon opening of the lid 14 with the release of the jack 16 from the interior of the body 12, the lid 14 assumes the orientation seen in FIG. 2. When the lid is so oriented as seen in FIG. 2, its weight is no longer distributed to the guide wheel 28, but is taken up almost exclusively by the wheels 20 and 22. In fact, the location of its hinge points about the upper rear edge causes a component of force to be downwardly directed along the backedge of the body 12, tending to pivot the totality of the toy 10 such that very little weight is placed on the guide wheel 28. As such, the toy 10 no longer pivots about the guide wheel 28, but either follows a path which is oriented along the line of orientation of the guide wheel 28 or follows a straight path when the guide wheel 28 is lifted completely free of the support surface, with the straight path being oriented along the line of orientation of the rear wheels 20 and 22.

The presence of the cut-outs 94 in the rear wheels 20 and 22 cause the toy 10 to bump as it moves under the rotation of the rear wheels 20 and 22. This bumping further contributes to both the pivoting action about the guide wheel 28 when the lid 14 is closed and the straight pathway taken by the toy 10 when the lid 14 is open. When the lid 14 is open, the bumping caused by the presence of the cut-outs 94 rocks the toy 10 such that weight is alternately removed from the guide wheel 28, at which time the toy 10 follows a straight track in lines with the wheels 20 and 22 and intermittently some of the weight of the toy 10 is taken up by the guide wheel 28, which allows the toy 10 to follow a very gentle arc. When the lid 14 is closed, the presence of the cut-outs 94 causes bumping of the toy 10 which tilts the weight of the toy 10 toward the front left hand edge 96 which completely takes any weight off the rear wheel 20, allowing for all movement of the toy 10 to be under the influence of contact between rear wheel 22 and the support surface. Since the rear wheel 22 is almost diagonally opposite to the guide wheel 28, this further contributes to the pivoting motion of the toy 10 about the front right hand edge 32 when the lid 14 is closed.

We claim:

1. A toy which comprises: a body, said body divided into at least a main section and a supplemental section;

a motor means located in said main section of said body;

a set of drive wheels operatively associated with said motor means so as to be rotated by said motor means, said set of drive wheels located on said main section of said body and positioned such that at least a portion of said drive wheels extend below said main section of said body and contact a support surface, one of said drive wheels located on one side of the longitudinal center line of said main section of said body and the other of said drive wheels located on the other side of the longitudinal center line of said main section of said body, both of said drive wheels located on one side of the transverse center line of said main section of said body;

a guide means located on said section of said body in a position such that at least a portion of said guide means contacts said support surface, said guide means located on one side of said longitudinal center line of said main section of said body and on the opposite side of said transverse center line of the main section of said body from said drive wheels;

said supplemental section pivotally mounted on said main section of said body at a point which is located on the same side of said transverse center line of said main section of said body as are said drive wheels, said supplemental section pivoting on said main section between at least a first position and a second position;

said drive wheels supporting at least a portion of the weight of said toy on a support surface and said guide means supporting the remaining portion of the weight of said toy on said support surface, the portion of the weight of said toy supported by said guide means being greater when said supplemental section of said body is in said first position than when said supplemental section of said body is in said second position such that as said drive wheels rotate said toy is propelled over said support surface and the direction of travel of said toy on said support surface when said supplemental section is in said first position is different than the direction of travel of said toy on said support surface when said supplemental section is in said second position.

2. The toy of claim 1 including:

supplemental section moving means operatively associated with said motor means and said supplemental section of said body, said supplemental section moving means for moving said supplemental section from said first position to said second position.

3. The toy of claim 2 wherein:

said toy travels in a first curved pathway when said supplemental section is in said first position and in one of a second curved pathway and a straight pathway when said supplemental section is in said second position, the radius of curvature of said first curved pathway being smaller than the radius of curvature of said second curved pathway.

4. The toy of claim 3 wherein:

said guide means comprises a guide wheel rotatably mounted on said main body section and located on said main body section such that at least a portion of said guide wheel extends below said main body section and contacts said support surface.

5. The toy of claim 4 wherein:

the line of travel of said guide wheel is oriented at an acute angle to the line of travel of the one of said drive wheels which is located on the same side of said longitudinal center line of said main section of said body as is said guide wheel.

6. The toy of claim 5 wherein:

each of said drive wheels includes a discontinuity in the periphery of said drive wheels such that the circumference of said drive wheels does not form a continuous circle.

7. The toy of claim 6 wherein:

said discontinuity in the periphery of said drive wheels is an opening located in the circumference of each of said drive wheels.

8. The toy of claim 7 wherein:

said opening in one of said drive wheels is spaced approximately 180° from said opening in the other of said drive wheels.

9. The toy of claim 8 wherein:

said supplemental section moving means is capable of contacting said supplemental section and pivoting said supplemental section with respect to said main section of said body from said first position to said second position.

10. The toy of claim 9 wherein:

said supplemental section includes a hinged lid, said hinged lid hinged to said main section of said body and moving between a first position wherein said lid fits over said main section of said body and a second position wherein said lid extends away from said main section of said body on the same side of said transverse center line of said main section of said body as are located said drive wheels.

* * * * *